US009316384B2

(12) United States Patent
Mumma et al.

(10) Patent No.: US 9,316,384 B2
(45) Date of Patent: Apr. 19, 2016

(54) COLLAPSIBLE WORKLIGHT ASSEMBLY

(71) Applicants: Richard Russell Mumma, Roanoke, TX (US); Gary Van Deursen, Essex, CT (US)

(72) Inventors: Richard Russell Mumma, Roanoke, TX (US); Gary Van Deursen, Essex, CT (US)

(73) Assignee: International Development LLC, Roanoke, TX (US)

( * ) Notice: Subject to any disclaimer, the term of this patent is extended or adjusted under 35 U.S.C. 154(b) by 0 days.

(21) Appl. No.: 14/775,061

(22) PCT Filed: Mar. 12, 2014

(86) PCT No.: PCT/US2014/024638
§ 371 (c)(1),
(2) Date: Sep. 11, 2015

(87) PCT Pub. No.: WO2014/165170
PCT Pub. Date: Oct. 9, 2014

(65) Prior Publication Data

US 2016/0033119 A1 Feb. 4, 2016

Related U.S. Application Data

(60) Provisional application No. 61/777,085, filed on Mar. 12, 2013.

(51) Int. Cl.

| | |
|---|---|
| ***F21V 21/06*** | (2006.01) |
| ***F21V 21/14*** | (2006.01) |
| ***F21L 14/00*** | (2006.01) |
| ***F21V 21/22*** | (2006.01) |

(Continued)

(52) U.S. Cl.
CPC ..... *F21V 21/145* (2013.01); *F21L 14/00* (2013.01); *F21V 21/22* (2013.01); *F21V 21/30* (2013.01); *F21W 2131/1005* (2013.01); *F21Y 2101/02* (2013.01); *F21Y 2105/001* (2013.01)

(58) Field of Classification Search
CPC ..... F21V 21/145; F21V 21/30; F21V 21/22; F21L 14/00
See application file for complete search history.

(56) References Cited

U.S. PATENT DOCUMENTS

| | | | |
|---|---|---|---|
| 5,424,931 | A | 6/1995 | Wheeler |
| 2003/0103357 | A1 | 6/2003 | Drake |

(Continued)

FOREIGN PATENT DOCUMENTS

| | | | |
|---|---|---|---|
| GB | 2221978 | A | 2/1990 |

OTHER PUBLICATIONS

International Search Report and The Written Opinion of the International Searching Authority dated Jul. 17, 2014 from related PCT App. No. PCT/US2014/024638.

(Continued)

*Primary Examiner* — David V Bruce
(74) *Attorney, Agent, or Firm* — Brian Harris

(57) ABSTRACT

A collapsible worklight assembly comprises a head assembly and a multi-legged support assembly. The head assembly includes first and second worklights hingedly attached to each other, allowing the head assembly to be open in a deployed configuration and closed in a collapsed configuration. The head assembly is hingedly attached to the multi-legged support assembly. The multi-legged support assembly includes a support head and a plurality of support legs. The support head includes a hinged connection to the head assembly that allows the plurality of support legs to rotate towards the head assembly in a collapsed configuration and away from the head assembly in a deployed configuration.

16 Claims, 8 Drawing Sheets

(51) Int. Cl.

| | |
|---|---|
| ***F21V 21/30*** | (2006.01) |
| *F21W 131/10* | (2006.01) |
| *F21Y 101/02* | (2006.01) |
| *F21Y 105/00* | (2006.01) |

(56) References Cited

U.S. PATENT DOCUMENTS

2006/0279948 A1* 12/2006 Tsai ..... F21V 21/116 362/190
2009/0284963 A1 11/2009 Intravatola
2010/0246187 A1 9/2010 Yoshimori
2011/0019423 A1 1/2011 Ko
2011/0216532 A1 9/2011 Bryant
2012/0168576 A1 7/2012 Intravatola

OTHER PUBLICATIONS

International Preliminary Report on Patentability dated Mar. 3, 2015 from related PCT App. No. PCT/US2014/024638.

* cited by examiner

COLLAPSIBLE WORKLIGHT ASSEMBLY

This application claims the benefit of U.S. Provisional Application No. 61/777,085, filed 12 Mar. 2013, which is hereby incorporated herein by reference.

TECHNICAL FIELD

The present disclosure relates to portable worklights and stands, particularly portable worklights that can be supported by a multi-legged support structure.

BACKGROUND

Portable worklights are known that can be supported by a multi-legged support structure. Such worklights are commonly used wherever portable light sources may be needed, such as on temporary work sites. However, such worklights and support structures typically include a number of parts that must be assembled and disassembled when the worklight is moved from one location to another. Such construction also makes it necessary to have an additional case or box to store the various pieces whenever the worklight is in transport or storage.

For example, U.S. Pat. No. 5,964,524 to Qian discloses a worklight and stand having a multi-legged support and a main pole consisting of three segments. Qian discloses that the worklight and stand can be broken into several pieces and stored within a separate container.

While there are advantages to such worklights and stands, such as providing a portable light source, such worklights and stands are subject to time-consuming setup and teardown and are susceptible to loss of parts, especially on job sites where the worklight might be torn down or set up under limited light conditions or other conditions where parts can easily be misplaced.

SUMMARY

The present disclosure provides an improved portable worklight assembly that includes a collapsible support structure that can easily be deployed and collapsed without the need for assembly/disassembly of multiple parts or for a separate storage container.

According to some aspects of the present disclosure, a collapsible worklight assembly comprises a head assembly and a multi-legged support assembly. The head assembly includes a first worklight and a second worklight hingedly attached to the first worklight. The multi-legged support assembly includes a support head and a plurality of support legs connected to the support head. The multi-legged support assembly is hingedly attached to the head assembly via the support head. The head assembly can include a tension knob for controlling the ease with which the multi-legged support assembly can be rotated relative to the head assembly. The plurality of legs can each include a respective plurality of leg segments. The legs can of fixed or adjustable length. Preferably, the legs are telescopically lengthwise adjustable.

The first and second worklights can be hingedly attached to each other so as to be rotatable relative to each other about a first axis, and the multi-legged support assembly can be hingedly attached to the head assembly such that the plurality of legs can be rotated relative to the head assembly about a second axis. In some embodiments, the first axis can be substantially orthogonal to the second axis. In some embodiments, the collapsible worklight assembly can further include a handle connected between the first and second worklights.

The handle can be configured so that the longitudinal axis of the handle is at least somewhat parallel to the first axis. The first and second worklights can include respective first and second worklight housings, where the first worklight housing is connected to the handle via a first plurality of arms, and the second worklight housing is connected to the handle via a second plurality of arms.

The plurality of legs can be rotatable relative to the head assembly to a collapsed configuration. While in the collapsed configuration, a first support leg of the plurality of legs can be adjacent to the first worklight and a second support leg of the plurality of legs can be adjacent to the second worklight. The first support leg can be held adjacent to the first worklight by a first support-retaining member, and the second support leg can be held adjacent to the second worklight by a second support-retaining member.

The first and second worklights include respective first and second light panels. In some embodiments, the light panels can each include a plurality of light emitting diodes (LEDs) and/or other light sources. The first and second worklights can be hingedly attached to each other so as to be rotatable between a collapsed configuration and a deployed configuration, where the first and second light panels face each other in the collapsed configuration.

The first and second worklights can include respective power switches. Alternatively, the first and second worklights can be configured to be powered together via a single power switch.

The collapsible worklight assembly can further include one or more expansion packs. Each expansion pack includes one or more additional worklights that can be removably attached to the head assembly. For example, in some embodiments, an expansion pack can be somewhat identical to the head assembly. So in such embodiments, the expansion pack can include first and second worklight hingedly attached to each other.

BRIEF DESCRIPTION OF THE DRAWINGS

Features, aspects, and embodiments of the present disclosure are described in conjunction with the attached drawings, in which.

DETAILED DESCRIPTION

Figure 1:
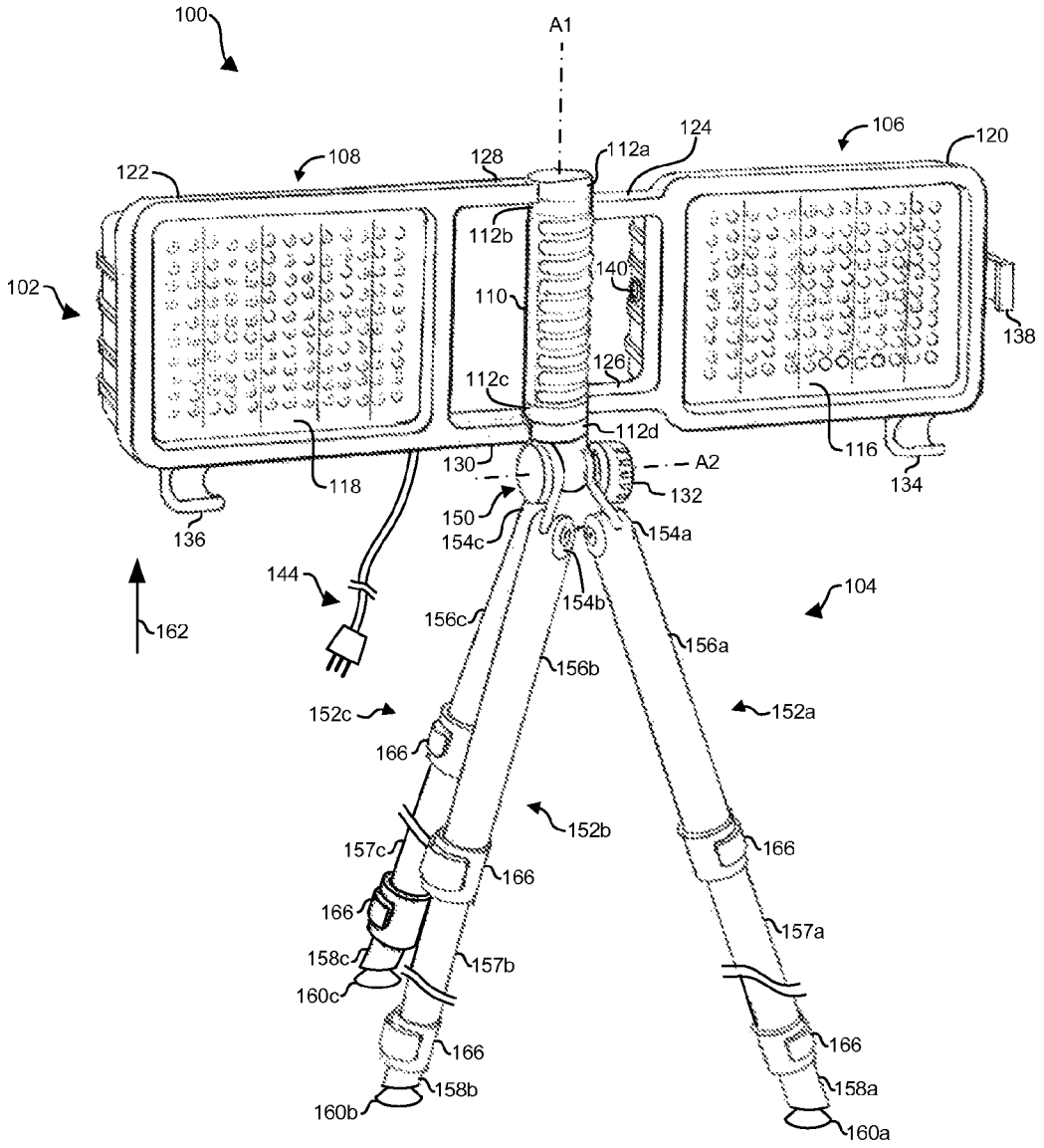
FIG. 1 shows a perspective view of a worklight assembly according to the present disclosure in a deployed configuration.
Figure 2:
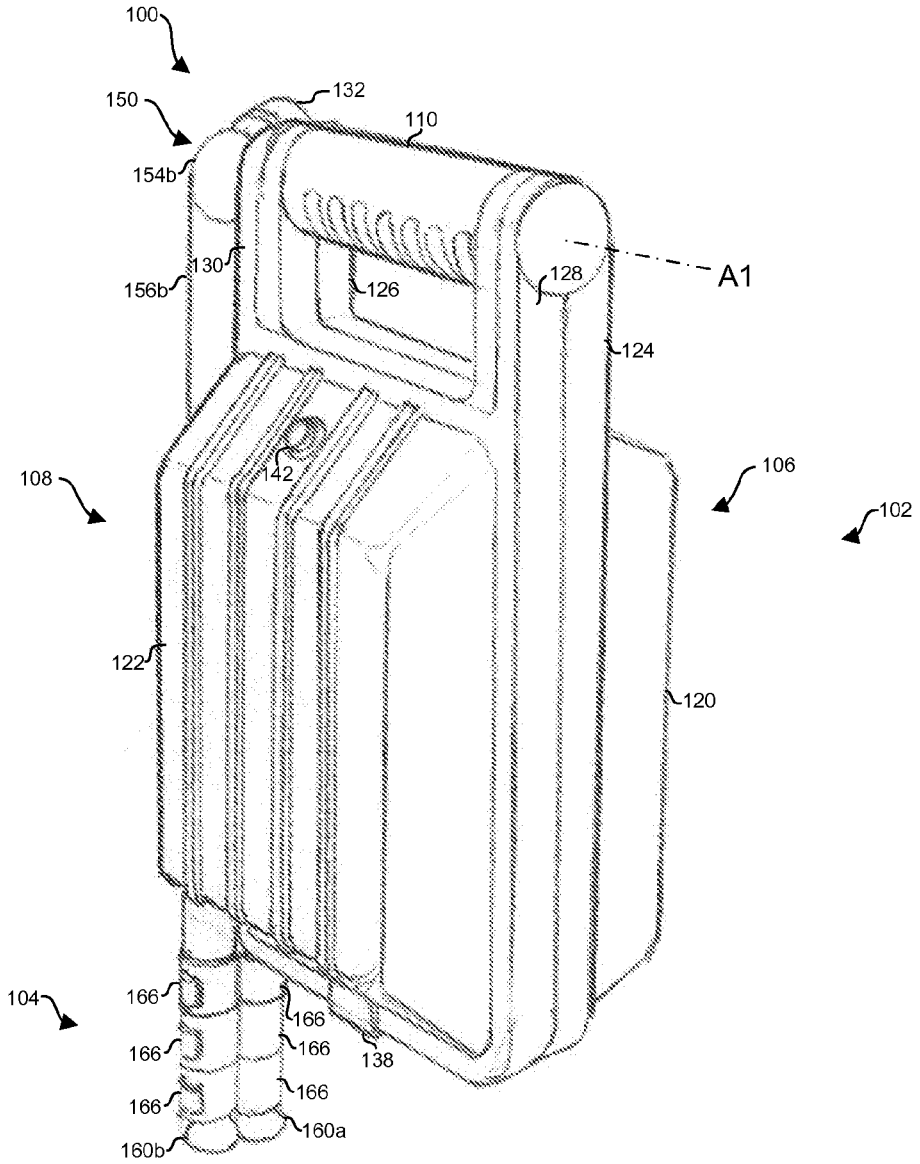
FIG. 2 shows a perspective view of the worklight assembly shown in FIG. 1, but in a collapsed configuration.
Figure 6:
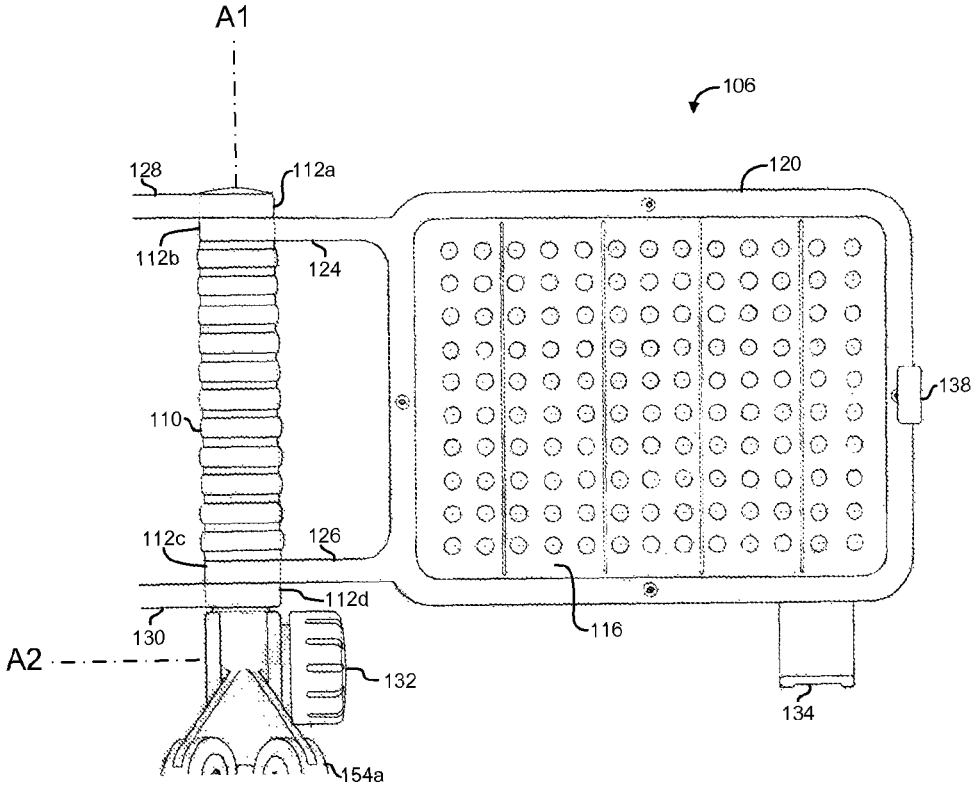
FIG. 6 shows a front view of a portion of the deployed worklight assembly shown in FIG. 1.

FIGS. 1-6 show an embodiment of a worklight assembly 100. FIGS. 1 and 6 show the worklight assembly 100 in a deployed state, whereas FIGS. 2-5 show the worklight assembly 100 in a collapsed state. The worklight assembly 100 includes a head assembly 102 connected to a multi-legged support assembly 104. In the deployed state, the head assembly 102 is supported by the multi-legged support assembly 104 so that the worklight assembly 100 can be used to illuminate an adjacent area. In the collapsed state, the head assembly 102 and multi-legged support assembly 104 are folded together so that the worklight assembly 100 can easily be transported or stored while not in use.

The head assembly 102 includes a first worklight 106 and a second worklight 108. The worklights 106 and 108 are both hingedly connected to a handle 110. The worklights 106 and 108 can be swiveled relative to the handle 110 by means of articulated joints 112*a*, 112*b*, 112*c*, and 112*d*. The articulated joints 112*a*-112*d* allow the worklights 106 and 108 to move between the deployed configuration shown in FIGS. 1 and 6, and the collapsed configuration shown in FIGS. 2-5. More specifically, the worklights 106 and 108 are configured to rotate relative to each other about a longitudinal axis A1 of the handle 110. In the view shown in FIG. 1, the worklights 106 and 108 have been rotated 180 degrees about axis A1 from the collapsed configuration shown in FIG. 2. In some embodiments, 180 degrees can be the maximum open angle such that the configuration shown in FIG. 1 would be a fully-opened state. However, alternative embodiments can be configured for other maximum angles, including angles greater than and less than 180 degrees.

Worklights 106 and 108 each include a respective one of light panels 116 and 118. In the preferred embodiment, the light panels 116 and 118 each include a plurality of LEDs, however other light sources can be used. The light panels 116 and 118 can be substantially identical to each other, for example both including the same number of LEDs arranged in the same pattern, or the light panels 116 and 118 can differ from each other, for example one having more LEDs than the other. The exact number, arrangement, and types of LEDs can vary. In one embodiment, for example, light panels 116 and 118 can be configured to emit about 6,000 Lumens each so that the light panels 116 and 118 together can emit about 12,000 Lumens. However, alternative embodiments can be configured to emit any of a great variety of different Lumen values. Also, in some embodiments, the worklights 106 and 108 can include multiple brightness settings. For example, worklights 106 and 108 can include a "HIGH" setting and a "LOW" setting, where more lumens are emitted in the "HIGH" setting than in the "LOW" setting. In one such embodiment, as an example, light panels 116 and 118 can be configured to emit about 6,000 Lumens each in the "HIGH" setting and about 3,000 Lumens each in the "LOW" setting.

In some embodiments, the worklights 106 and 108 can be configured to be independently turned on and off, for example so that a user can turn on/off only one or both of the worklights 106 and 108 if so desired. For example, in the illustrated embodiment, each of the worklights 106 and 108 includes a respective one of power switches 140 and 142. Alternatively, the worklights 106 and 108 can be controlled to only be turned on and off together, for example from a single power switch.

The worklights 106 and 108 can be battery-powered, solar-powered, and/or include means for receiving electrical power from an outside power source. For example, one or both of the worklights 106 and 108 can include a power cord 144.

The light panels 116 and 118 are supported by respective worklight housings 120 and 122. The worklight housings 120 and 122 are preferably formed of a durable rigid material, such as a plastic or metal material.

The worklight housing 120 includes an upper arm 124 and a lower arm 126 for connecting the worklight housing 120 to the articulated joints 112*b* and 112*c*, respectively. The worklight housing 122 includes an upper arm 128 and a lower arm 130 for connecting the worklight housing 122 to the articulated joints 112*a* and 112*d*, respectively. The arms 124, 126, 128, and 130 also serve to distance the worklight housings 120 and 122 from the handle 110 so that a user can easily grip the handle 110 when the worklight assembly 100 is in the collapsed configuration.

Figure 3:
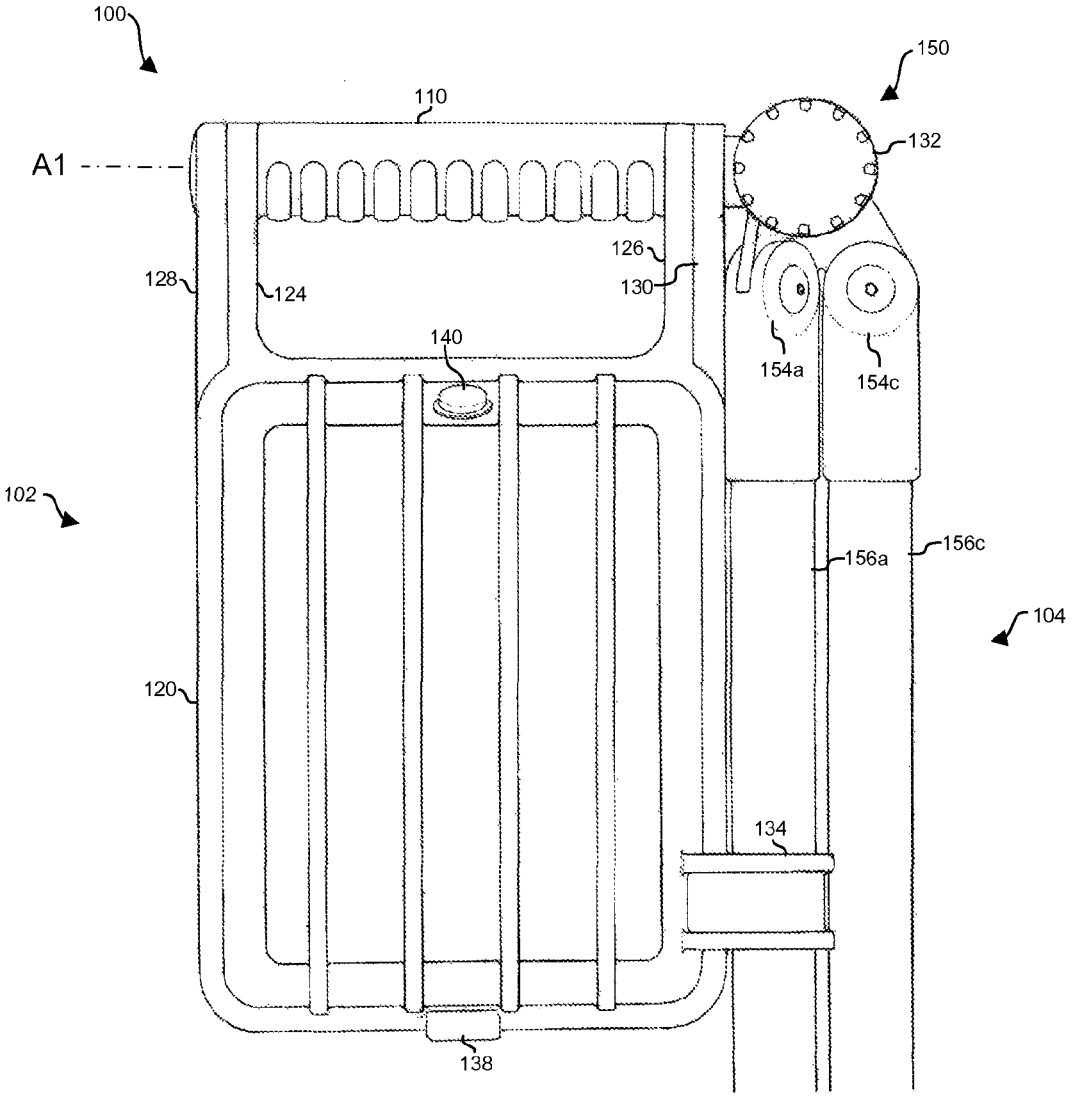
FIG. 3 shows a side view of the collapsed worklight assembly shown in FIG. 2.
Figure 4:
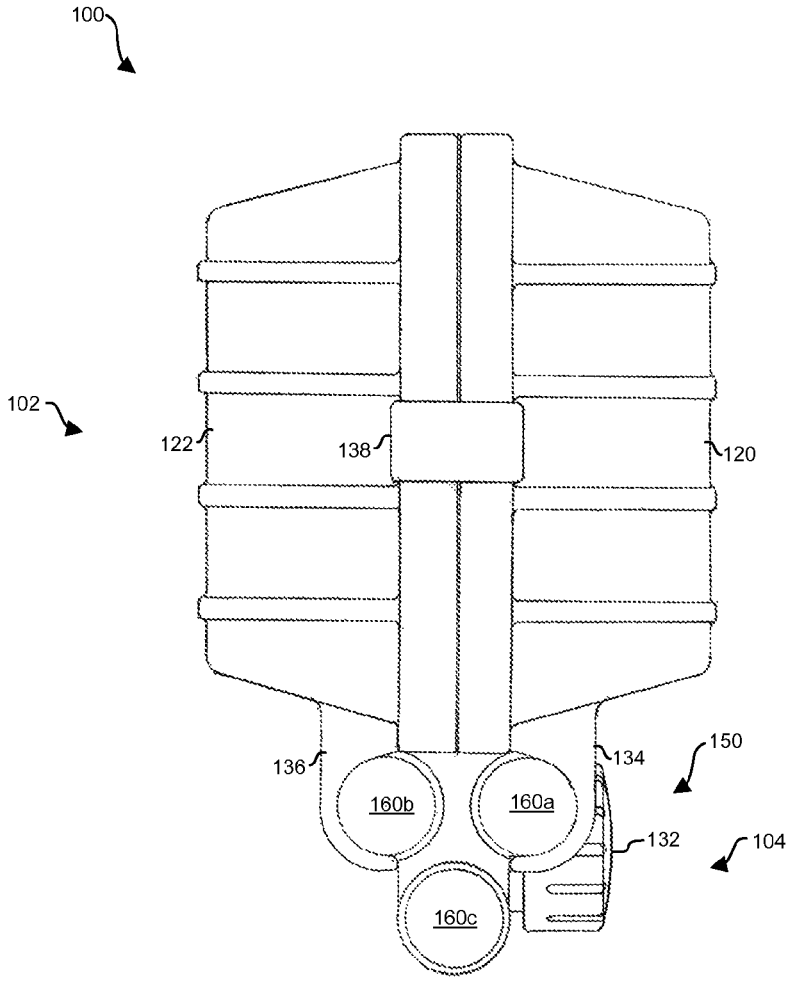
FIG. 4 shows a bottom view of the collapsed worklight assembly shown in FIG. 2.
Figure 5:
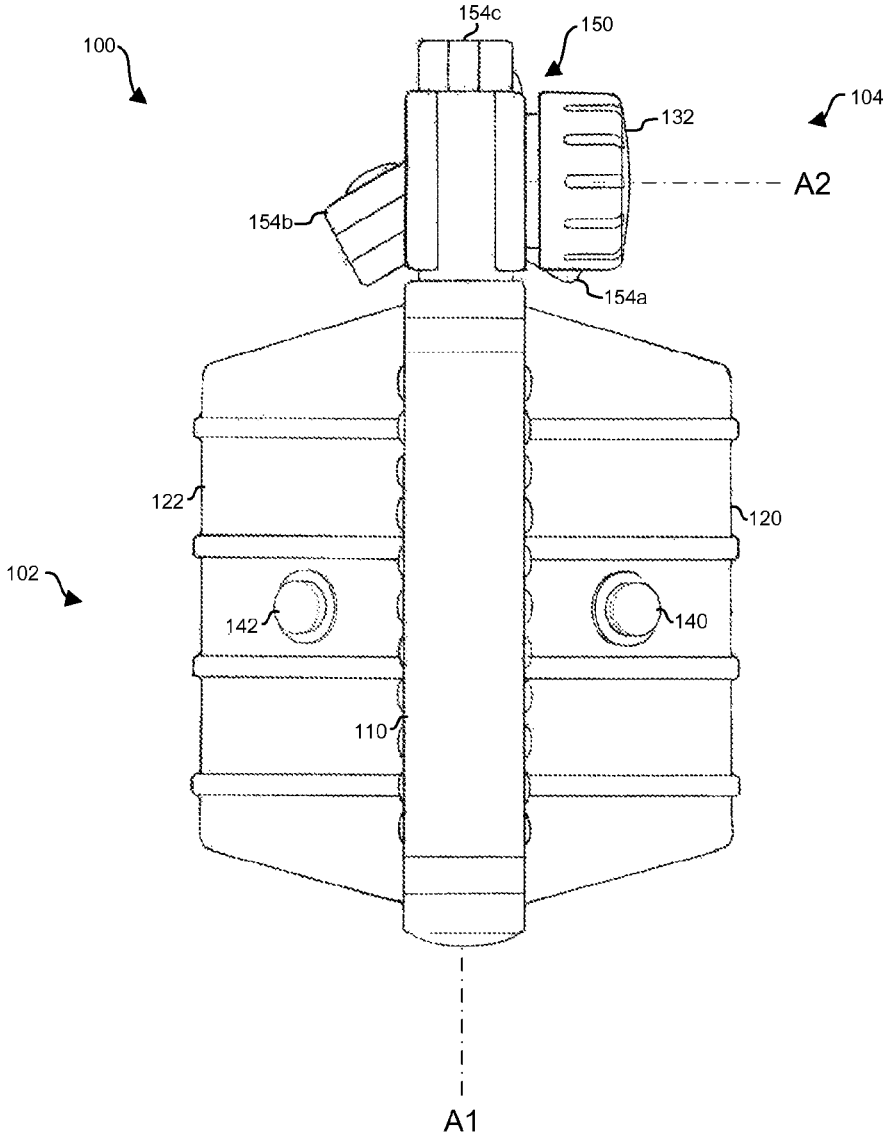
FIG. 5 shows a top view of the collapsed worklight assembly shown in FIG. 2.

The worklight housings 120 and 122 also include respective support-retaining members 134 and 136. Referring to FIG. 3, the support-retaining members 134 and 136 help to secure the multi-legged support assembly 104 relative to the head assembly 102 while the worklight assembly 100 is in the collapsed configuration.

The worklight housing 120 also includes a spring latch 138. Referring to FIG. 3, the spring latch 138 helps to secure the worklight housing 120 and the worklight housing 122 together in the collapsed configuration. The spring latch 138 can be operated by a user to release the worklight housing 122 from the worklight housing 120 in order to deploy the worklight assembly 100.

The head assembly 102 is connected to the multi-legged support assembly 104 via a support head 150 of the multi-legged support assembly 104. The support head 150 includes a tension knob 132 that can be loosened to allow the head assembly 102 to rotate about axis A2 relative to the multi-legged support assembly 104. The tension knob 132 can also be tightened to hold the head assembly 102 in place relative to the multi-legged support assembly 104.

In the illustrated embodiment, the multi-legged support assembly 104 is a tripod, however the multi-legged support assembly 104 can have another number of support legs in alternative embodiments. The multi-legged support assembly 104 comprises a support head 150 and three support legs 152*a*-152*c* that are configured so as to be identical and connected to the support head 150 by means of respective articulated joints 154*a*-154*c*. The support legs 152*a*-152*c* can be swiveled relative to the support head 150 within an angular range by means of the articulated joints 154*a*-154*c*. The tripod legs 152*a*-152*c* each include a respective upper leg section 156*a*-156*c*, a respective middle leg section 157*a*-157*c*, and a respective lower leg section 158*a*-158*c*. Upper leg sections 156*a*-156*c* are each connected to a respective one of the articulated joints 154*a*-154*c*, and lower leg sections 158*a*-158*c* are each connected to a respective one of the support feet 160*a*-160*c*.

The maximum height of the multi-legged support assembly 104 in the height direction 162 is dependent on the length and on the standing position of the support legs 152*a*-152*c*. In order to extend the height range of the multi-legged support assembly 104, the support legs 152*a*-152*c* include respective leg sections 156*a*-158*c*, 156*b*-158*b*, and 156*c*-158*c* that can be slid telescopically relative to each other (e.g., lower leg section 158*a* can slide in and out of middle leg section 157*a*, and middle leg section can slide in and out of upper leg section 156*a*). The leg sections 156-158 can be clamped to prevent the telescopic sliding with respect to each other by means of clamping mechanisms 166 that are configured in the form of a clamping lever. The support legs 152*a*-152*c* can be collapsed by releasing the clamping mechanisms 166 and sliding the respective lower leg sections 158*a*-158*c* into respective middle leg sections 157*a*-157*c*, and sliding the respective middle leg sections 157*a*-157*c* into the respective upper leg sections 158*a*-158*c*.

The worklight assembly 100 can be collapsed (e.g., from the deployed configuration shown in FIG. 1) by collapsing the support legs 152*a*-152*c*, then swiveling the support legs 152*a*-152*c* towards each other relative to the support head 150 by means of the articulated joints 154*a*-154*c*, then loosening the tension knob 132 and rotating the multi-legged support assembly 104 about axis A2 such that two of the support legs 152 are somewhat aligned with support-retaining members 134 and 136, then closing the head assembly 102 (folding worklights 106 and 108 towards each other about axis A1) so as to retain two of the support legs 152 in place with the support-retaining members 134 and 136. Also, the head assembly 102 can be closed and held closed by latch 138. The process can be reversed in order to deploy the worklight assembly 100.

Figure 7A:
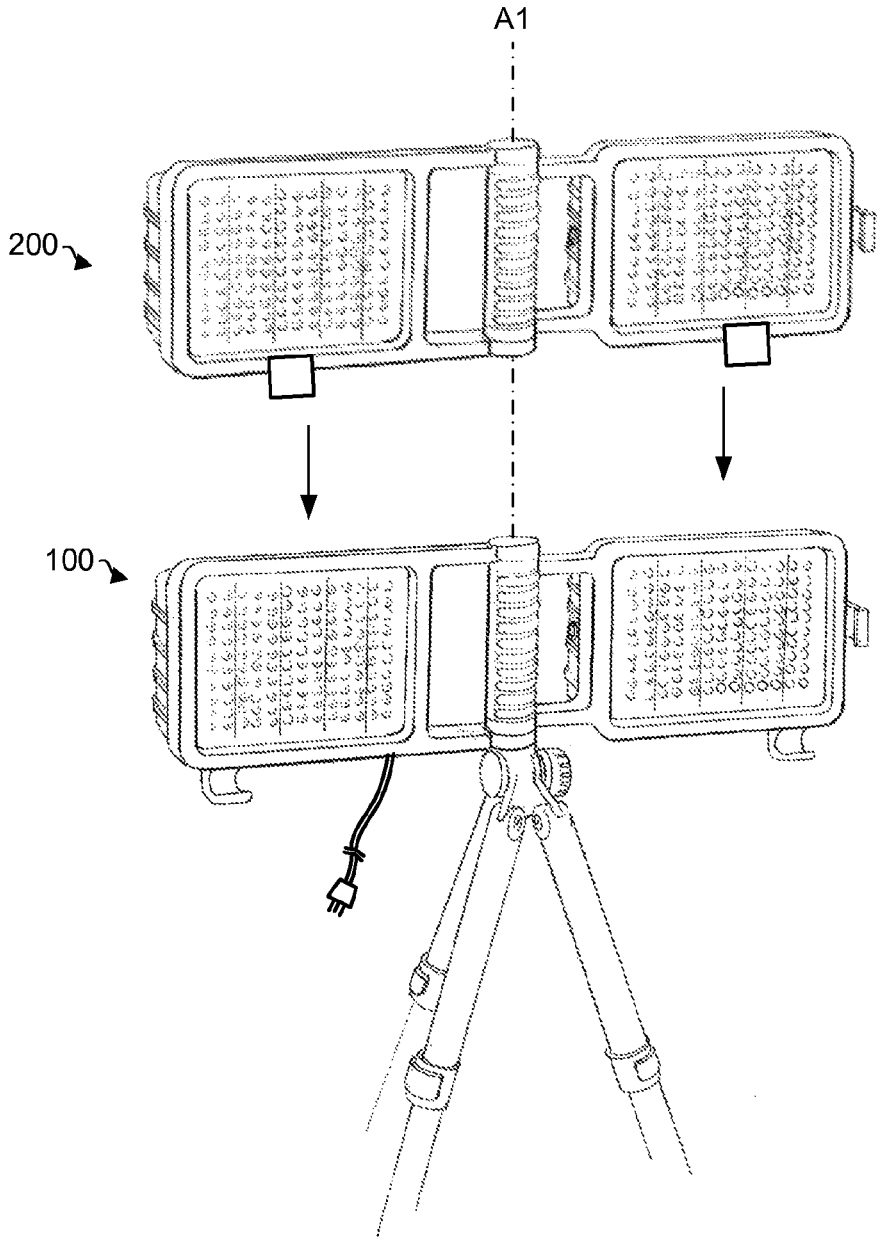
FIGS. 7A and 7B show perspective views of an expansion pack being attached to the worklight assembly shown in FIG. 1.
Figure 7B:
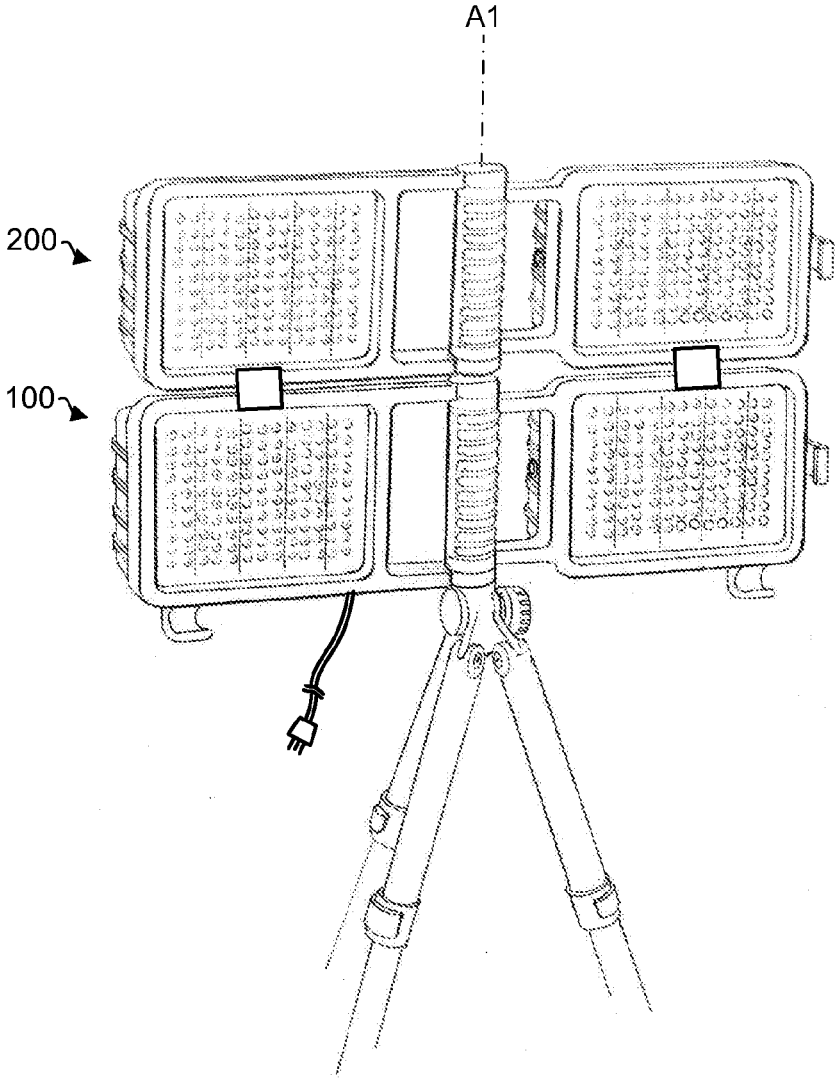

Referring next to FIGS. 7A and 7B, an expansion pack 200 can be included with the worklight assembly 100 for providing additional light when desired. The expansion pack 200 can be substantially the same as the head assembly 102, except that the expansion pack 200 can be removably attached to the top of the head assembly 102. So, for example, the expansion pack 200 can be collapsed and deployed in the same way as described above for the head assembly 102. While only one expansion pack 200 is shown, in some embodiments two or more such expansion packs 200 can be provided for allowing for still higher illumination levels.

FIGS. 7A and 7B show how the expansion pack 200 can be mechanically attached to the top of the head assembly 102 through the use of one or more clamps 202. In some embodiments, the expansion pack 200 can also be electrically connected to the head assembly 102 so that the expansion pack 200 can be turned on and off with the work lights 106 and 108.

While various embodiments in accordance with the disclosed principles have been described above, it should be understood that they have been presented by way of example only, and are not limiting. Thus, the breadth and scope of the invention(s) should not be limited by any of the above-described exemplary embodiments, but should be defined only in accordance with the claims and their equivalents issuing from this disclosure. Furthermore, the above advantages and features are provided in described embodiments, but shall not limit the application of such issued claims to processes and structures accomplishing any or all of the above advantages.

Additionally, the section headings shall not limit or characterize the invention(s) set out in any claims that may issue from this disclosure. Any reference in this disclosure to "invention" in the singular should not be used to argue that there is only a single point of novelty in this disclosure. Multiple inventions may be set forth according to the limitations of the multiple claims issuing from this disclosure, and such claims accordingly define the invention(s), and their equivalents, that are protected thereby. In all instances, the scope of such claims shall be considered on their own merits in light of this disclosure, but should not be constrained by the headings set forth herein.

What is claimed is:

1. A collapsible worklight assembly, comprising:

a head assembly comprising a first worklight and a second worklight hingedly attached to the first worklight;

a multi-legged support assembly comprising a support head and a plurality of support legs connected to the support head; and a handle connected between the first and second worklights, wherein the multi-legged support assembly is hingedly attached to the head assembly via the support head, wherein the first and second worklights are hingedly attached to each other so as to be rotatable relative to each other about a first axis, wherein the longitudinal axis of the handle is parallel to the first axis, wherein the plurality of legs are rotatable relative to the head assembly to a collapsed configuration, and wherein, while in the collapsed configuration, a first support leg of the plurality of legs is adjacent to the first worklight and orthogonal to the first axis.

2. The collapsible worklight assembly of claim 1, wherein the multi-legged support assembly is hingedly attached to the head assembly such that the plurality of legs are rotatable relative to the head assembly about a second axis.

3. The collapsible worklight assembly of claim 2, wherein the first axis is substantially orthogonal to the second axis.

4. The collapsible worklight assembly of claim 2, wherein the first and second worklights include respective first and second worklight housings, wherein the first worklight housing is connected to the handle via a first plurality of arms, and wherein the second worklight housing is connected to the handle via a second plurality of arms.

5. The collapsible worklight assembly of claim 2, wherein, while in the collapsed configuration, a second support leg of the plurality of legs is adjacent to the second worklight.

6. The collapsible worklight assembly of claim 5, wherein, while in the collapsed configuration, the first support leg is held adjacent to the first worklight by a first support-retaining member, and the second support leg is held adjacent to the second worklight by a second support-retaining member.

7. The collapsible worklight assembly of claim 1, wherein the first and second worklights include respective first and second light panels.

8. The collapsible worklight assembly of claim 7, wherein the first and second worklights are hingedly attached to be rotatable between a collapsed configuration and a deployed configuration, wherein the first and second light panels face each other in the collapsed configuration.

9. The collapsible worklight assembly of claim 7, wherein the first and second light panels each include a respective plurality of light emitting diodes.

10. The collapsible worklight assembly of claim 1, wherein the first and second worklights include respective power switches.

11. The collapsible worklight assembly of claim 1, wherein the first and second worklights are configured to be powered together via a single power switch.

12. The collapsible worklight assembly of claim 1, further comprising a power cord for transferring electrical power to at least one of the first and second worklights.

13. The collapsible worklight assembly of claim 1, further comprising an expansion pack comprising a third worklight and a fourth worklight hingedly attached to the third worklight, wherein the expansion pack is configured to be removably attached to the head assembly.

14. The collapsible worklight assembly of claim 1, wherein each of the plurality of legs includes a respective plurality of leg segments.

15. The collapsible worklight assembly of claim 14, wherein each of the plurality of legs is telescopically lengthwise adjustable.

16. The collapsible worklight assembly of claim 1, wherein the head assembly includes a tension knob for controlling the ease with which the multi-legged support assembly can be rotated relative to the head assembly.

* * * * *